US006083331A

United States Patent [19]

Taylor et al.

[11] Patent Number: 6,083,331

[45] Date of Patent: Jul. 4, 2000

[54] BURN RATE-ENHANCED HIGH GAS YIELD NON-AZIDE GAS GENERANTS

[75] Inventors: Robert D. Taylor, Hyrum; Ivan V. Mendenhall, Providence, both of Utah

[73] Assignee: Autoliv ASP, Inc., Ogden, Utah

[21] Appl. No.: 09/391,163

[22] Filed: Sep. 8, 1999

Related U.S. Application Data

[62] Division of application No. 09/221,910, Dec. 28, 1998.

[51] Int. Cl.[7] ..... D03D 23/00

[52] U.S. Cl. ..... 149/109.6; 149/46; 423/397

[58] Field of Search ..... 149/46, 109.6; 556/110, 118; 423/351, 387, 395, 397

[56] References Cited

U.S. PATENT DOCUMENTS 5,053,086 10/1991 Henry et al. ..... 149/19.4
5,139,588 8/1992 Poole ..... 149/61
5,460,668 10/1995 Lyon ..... 149/36
5,516,377 5/1996 Highsmith et al. ..... 149/18
5,518,054 5/1996 Mitson et al. ..... 149/35
5,608,183 3/1997 Barnes et al. ..... 149/45
5,725,699 3/1998 Hinshaw et al. ..... 149/19.1
5,735,118 4/1998 Hinshaw et al. ..... 60/219

*Primary Examiner*—Charles T. Jordan
*Assistant Examiner*—Aileen J. Baker

[57] ABSTRACT

Gas generant compositions and methods of processing are provided which produce or result in a relatively high burning rate and low burning rate pressure exponent, while also desirably providing a high gas output, as compared to normal or typical gas generant formulations such as used in association with vehicle occupant restraint airbag cushions.

20 Claims, No Drawings

BURN RATE-ENHANCED HIGH GAS YIELD NON-AZIDE GAS GENERANTS

CROSS REFERENCE TO RELATED APPLICATION

This application is a divisional of co-pending patent application Ser. No. 09/221,910, filed on Dec. 28, 1998.

BACKGROUND OF THE INVENTION

This invention relates generally to gas generant compositions, such as those used to inflate automotive inflatable restraint airbag cushions and, more particularly, to burn rate-enhanced, high gas yield non-azide gas generant compositions.

The burning rate for a gas generant composition can be represented by the equation (1), below:

$$Rb=Bp^n \quad (1)$$

where,

Rb=burning rate (linear)

B=constant

P=pressure n=pressure exponent, where the pressure exponent is the slope of the plot of the log of pressure along the x-axis versus the log of the burn rate alone the y-axis Gas generant compositions commonly utilized in the inflation of automotive inflatable restraint airbag cushions have previously most typically employed or been based on sodium azide. Such sodium azide-based compositions, upon initiation, normally produce or form nitrogen gas. While the use of sodium azide and certain other azide-based gas generant materials meets current industry specifications, guidelines and standards, such use may involve or raise potential concerns such as involving the safe and effective handling, supply and disposal of such gas generant materials.

Certain economic and design considerations have also resulted in a need and desire for alternatives to azide-based pyrotechnics and related gas generants. For example, interest in minimizing or at least reducing the overall space requirements for inflatable restraint systems and particularly such requirements related to the inflator component of such systems has stimulated a quest for gas generant materials which provide relatively higher gas yields per unit volume as compared to typical or usual azide-based gas generants. Further, automotive and airbag industry competition has generally lead to a desire for gas generant compositions which satisfy one or more conditions such as being composed of or utilizing less costly ingredients or materials and being amenable to processing via more efficient or less costly gas generant processing techniques.

As a result, the development and use of other suitable gas generant materials has been pursued. In particular, such efforts have been directed to the development of azide-free gas generants for use in such inflator device applications. In view of the above, there is a need and a desire for an azide-free gas generant material that, while overcoming at least some of the potential problems or shortcomings of azide-based gas generants, may also provide relatively high gas yields, such as compared to typical azide-based gas generants. In particular, relatively low cost gas generant material solutions to one or more such problems or limitations are desired.

Through such developmental work, various combinations of fuels and oxidizers have been proposed for use as gas generant materials. Ammonium nitrate is a relatively low cost, commercially available material which, when combined with an appropriate fuel material, may provide or result in relatively high gas output. Unfortunately, certain disadvantages or shortcomings may be associated with the use of ammonium nitrate as the sole oxidizer of such gas generants. For example, such use may result in a gas generant material having a relatively low burning rate, a relatively high burning rate pressure exponent (i.e., the burning rate of the material has a high dependence on pressure) and relatively high hygroscopicity.

In view thereof the burning rates of certain ammonium nitrate-containing compositions have been enhanced variously through the inclusion of one or more selected additives, e.g., a selected high energy fuel ingredient, or by the addition of co-oxidizers such as ammonium and potassium perchlorate. While the inclusion of such high energy fuel ingredients may enhance the burn rate, further increased burn rates are generally desired. In addition, none of such high energy fuel additives are generally effective in significantly reducing the burning rate pressure exponent, as identified above. As will be appreciated, a relatively low burning rate pressure exponent is generally desirable for such compositions such as to reduce the ballistic variability of corresponding airbag inflator devices. In practice, most ammonium nitrate-containing gas generant compositions have a burning rate pressure exponent of approximately 0.75, which is very high relative to the generally desired level of less than 0.60.

Moreover, the inclusion and use of the latter co-oxidizers in gas generant formulations, such as for airbag applications, may be deemed objectionable due to possible concerns regarding toxicity of effluent gas (e.g., formation of objectionable HCl gas) and difficulty in filtering certain undesirable by-products (e.g., alkali metal chlorides) from the gas stream of the associated inflator device.

In addition, ammonium nitrate is known to typically undergo various changes in crystalline structure over the normally expected or anticipated range of storage conditions, e.g., temperatures of about −40° C. to about 110° C. These changes in structure typically involve expansion and contraction of the solid material. Such changes, even when relatively minute, can strongly influence the physical properties of a corresponding gas generant material and, in turn, strongly affect the burn rate of the generant material. Unless checked, such changes in ammonium nitrate structure may result in such performance variations in the gas generant materials incorporating such ammonium nitrate as to render such gas generant materials unacceptable for typical inflatable restraint system applications.

Thus, there is a continuing need and a demand for an azide-free gas generant material that, while overcoming at least some of the potential problems or shortcomings of azide-based gas generants, may also provide relatively high gas yields, such as compared to typical azide-based gas generants, and which provides or results in a sufficientness and desirably high burning rate and low burn a rate pressure exponent.

SUMMARY OF THE INVENTION

A general object of the invention is to provide an improved gas generant composition and method of forming a burn rate-enhanced high gas yield non-azide gas generant.

A more specific objective of the invention is to overcome one or more of the problems described above.

The general object of the invention can be attained, at least in part, through a gas generant composition which includes:

between about 30 and about 60 wt % of a gas generating fuel, between about 15 and about 55 wt % metal amine nitrate oxidizer, between about 2 and about 10 wt % metal oxide additive for burn rate enhancement and facilitating slag formation, and between about 0 and about 35 wt % ammonium nitrate supplemental oxidizer.

The prior art generally fails to provide gas generant materials which may provide relatively higher gas yields per unit volume as compared to typical or usual azide-based gas generants and which burn as quickly and with as reduced dependence on pressure as may be desired, while utilizing generally less costly ingredients or materials. In addition, the prior art fails to provide processing techniques whereby such gas generant materials can be appropriately and safely produced or formed.

The invention further comprehends a gas generant composition which includes:

between about 35 and about 50 wt % of guanidine nitrate fuel, between about 30 and about 55 wt % copper diamine dinitrate oxidizer, between about 2 and about 10 wt % silicon dioxide burn rate enhancing and slag formation additive, and between about 0 and about 25 wt % ammonium nitrate supplemental oxidizer.

The invention still further comprehends a method of forming a burn rate-enhanced high gas yield non-azide gas generant. The gas generant includes a gas generating fuel and between about 15 and about 55 wt % of a metal amine nitrate oxidizer wherein the metal of the metal amine nitrate is selected from the group of copper and zinc. Ammonium nitrate and a compound or material containing the metal of the metal amine nitrate are added with a first gas generant precursor material to form a second gas generant precursor material. The second gas generant precursor material is then heated to form a gas generant material containing between about 15 and about 55 wt % of:

copper diamine dinitrate, where the metal is copper and zinc diamine dinitrate, where the metal is zinc.

Other objects and advantages will be apparent to those skilled in the art from the following detailed description taken in conjunction with the appended claims.

DETAILED DESCRIPTION OF THE INVENTION

The present invention provides gas generant materials such as may be used in the inflation of inflatable devices such as vehicle occupant restraint airbag cushions. Such gas generant materials typically include a gas generating fuel component, a metal amine nitrate oxidizer component a metal oxide burn rate enhancing and slag formation additive component and, if desired, an ammonium nitrate supplemental oxidizer component.

In accordance with certain preferred embodiments of the invention, between about 30 and about 60 wt % of the subject gas generant material constitutes such gas generating fuel component. As discussed above, preferred fuel materials for use in the practice of the invention are non-azide in nature. Groups or categories of fuels useful in the practice of the invention include various nitrogen-containing organic fuel materials and tetrazole complexes of at least one transition metal. Specific examples of nitrogen-containing organic fuel materials useful in the practice of the invention include guanidine nitrate, aminoguanidine nitrate, triaminoguanidine nitrate, nitroguanidine, dicyandiamide, triazalone, nitrotriazalone, tetrazoles and mixtures thereof. Tetrazole complexes of transition metals such as copper, cobalt, and possibly zinc, for example, can be used. As will be appreciated, the gas generating fuel component of particular gas generant compositions in accordance with the invention may be comprised of individual such fuel materials or combinations thereof.

In addition, the fuel component of the subject gas generating material may, if desired, include a metallic fuel material. Specific examples of metallic fuels useful in the practice of the invention include silicon, aluminum, boron, magnesium, alloys of aluminum and magnesium and combinations thereof.

The fuel component of the subject gas generating material, in accordance with certain particularly preferred embodiments of the invention, includes the fuel materials guanidine nitrate or guanidine nitrate in combination with one or more metallic fuels of silicon, aluminum, boron, alloys of aluminum and magnesium alloys and combinations thereof. As will be appreciated, such metallic fuels may desirably be utilized in a powder form such as to facilitate mixing, and combination with other composition components. While the inclusion of such metallic fuels can serve various purposes, in general such metallic fuels may desirably be included in such compositions to increase the combustion temperature of the resulting composition.

In practice, guanidine nitrate is a generally particularly preferred fuel due to one or more various factors including: having a relatively low commercial cost; generally avoiding undesired complexing with copper or other transition metals which may also be present; is itself relatively highly oxygenated and thus may serve to minimize or reduce the amount of externally provided oxidant required for combustion. When included, the powders of silicon, aluminum, boron, alloys of aluminum and magnesium alloys and combinations thereof may generally desirably be present in an amount of up to about 5% of the total gas generant composition.

In accordance with certain preferred embodiments of the invention, between about 15 and about 55 wt % of the subject gas generant material constitutes such metal amine nitrate oxidizer. Preferred metal amine nitrate oxidizer materials for use in the practice of the invention include copper diamine dinitrate, zinc diamine dinitrate and combinations thereof.

Also, as identified above, the subject gas generant materials may, if desired, additionally contain up to about 35 wt % of an ammonium nitrate supplemental oxidizer component. Thus, in the broader practice of the invention, the subject gas generant materials may contain between about 0 and about 35 wt % of such an ammonium nitrate supplemental oxidizer component.

In accordance with the invention, it has been found that gas generant materials containing a substantial amount of metal amine nitrate relative to the amount of ammonium nitrate desirably provides or results in increased burning rates and a decreased burning rate pressure exponent. While it is appreciated that in practice the inclusion of such metal amine nitrate complexes in ammonium nitrate-containing compositions can serve to stabilize the phase changes normally associated with ammonium nitrate, the subject compositions include such metal amine nitrate complexes in relative amounts or levels substantially greater or higher than those required for stabilization. As described in greater detail below, the inclusion of such metal amine nitrate complexes in such relative amounts is believed to help result in the desired increase in burning rates and decrease in the burning rate pressure exponent. For example, in order to stabilize the phase changes of ammonium nitrate, a metal amine nitrate content of no more than about 15 wt % is generally required or desired. In contrast, in the subject compositions, the metal amine nitrate complexes are used at much greater or higher relative amounts or levels than required for stabilization and in most cases the amount or level of the metal amine nitrate complexes can exceed the level or amount of ammonium nitrate in the compositions. Thus, in describing the invention, such metal amine nitrate complexes are sometimes referred to as the dominant or primary oxidizer of the composition.

The subject gas generant materials additionally desirably contain between about 2 and about 10 wt % of such metal oxide burn rate enhancing and slag formation additive. Examples of particular metal oxide burn rate enhancing and slag formation additives useful in the practice of the invention include silicon dioxide, aluminum oxide, titanium dioxide, boron oxide and combinations thereof. In general, silicon dioxide, aluminum oxide and combinations thereof are preferred metal oxide additives for use in the practice of the invention. The use of the metal oxide is as a burn rate enhancer and for the purpose of producing slag which is easily filtered from the gas stream of an airbag inflator. The incorporation and use of such silicon and aluminum oxide materials are particularly effective in facilitating the production of a slag material which is relatively easily filtered from the gas stream of an airbag inflator.

In the practice of the invention, it is believed that the combination of such metal oxide component and the relatively high levels of metal amine nitrate present in the composition taken together are responsible for the high burning rate and the low burning rate pressure exponent of the compositions.

One particularly preferred gas generant composition in accordance with the invention includes:

between about 35 and about 50 wt % of guanidine nitrate fuel, between about 30 and about 55 wt % copper diamine dinitrate oxidizer, between about 2 and about 10 wt % silicon dioxide burn rate enhancing and slag formation additive, and between about 0 and about 25 wt % ammonium nitrate supplemental oxidizer.

As will be appreciated by those skilled in the art, gas generant compositions in accordance with the invention can be formed or produced employing various appropriate and proper methods or techniques. In accordance with one particularly desirable method of formation, the particular metal amine nitrate oxidizer (i.e., copper diamine dinitrate, zinc diamine dinitrate or combinations thereof), employed in the subject composition, is formed in-situ such as by reacting ammonium nitrate with an appropriate copper and/or zinc containing compound or material. For example, for copper diamine dinitrate, a copper-containing material such as Cu metal, $Cu_2O$, CuO or $Cu(OH)_2$ is mixed or otherwise appropriately contacted with ammonium nitrate and then heated, such as to a temperature of at least about 160° C. to form copper diamine dinitrate. Similarly, in the case of zinc-containing amine nitrate, i.e., zinc diamine dinitrate, a zinc-containing material such as zinc metal or zinc oxide is mixed or otherwise appropriately contacted with ammonium nitrate and then appropriately heated to form zinc diamine dinitrate.

As will be appreciated, copper diamine dinitrate is generally not water stable and may present various handling and processing complications and difficulties. The in-situ formation of such copper diamine dinitrate, such as described above, can desirably serve to avoid or minimize at least certain of such handling and processing complications and difficulties.

In accordance with at least certain preferred embodiments of the invention, burn rate-enhanced high gas yield non-azide gas generants of the invention can desirably be formed by adding ammonium nitrate and a compound or material containing the metal of the metal amine nitrate (e.g., copper or zinc-containing material) with what is referred to herein as "a first gas generant precursor material." As will be appreciated, such first precursor material may appropriately contain or include any or all of the balance of the gas generant composition or appropriate precursors thereof. For example, such first precursor may contain or include the fuel component of the gas generant material or one or more appropriate precursors thereof, the metal oxide burn rate enhancing and slag formation additive or precursor(s) thereof or various combinations of such materials.

The method of forming a burn rate-enhanced high gas yield non-azide gas generant in accordance with the invention will now be described with particular reference to the above-identified preferred gas generant composition which contains guanidine nitrate fuel, copper diamine dinitrate oxidizer, silicon dioxide burn rate enhancing and slag formation additive and, if desired up to about 25 wt % ammonium nitrate supplemental oxidizer.

Such composition can desirably be formed by mixing together the ingredients of: guanidine nitrate, silicon dioxide, ammonium nitrate and a copper-containing material, e.g., Cu metal, $Cu_2O$, CuO or $Cu(OH)_2$. The mixture is then heated to a temperature of approximately 160° C. to form the final products of guanidine nitrate, $SiO_2$, copper diamine dinitrate, and ammonium nitrate. In the case where Cu metal or $Cu_2O$ are used, the heating is desirably done with exposure to air to permit the oxidation of these materials to the CuO form.

It has unexpectedly been found that the reaction forming the copper diamine dinitrate proceeds at a significantly faster rate when starting with a copper-containing material such as $Cu_2O$ rather than commercially available CuO. It is theorized that the use of a starting material such as $Cu_2O$, results preliminarily in the in-situ formation of CuO and that such in-situ formed CuO is significantly more reactive than commercially available CuO. Thus, the invention may desirably employ a copper-containing material, such $Cu_2O$, which serves to form CuO in-situ, as the process proceeds.

It will also be appreciated that composition fuel components such as guanidine nitrate may also desirably be formed in the reaction mixture during the heating cycle. For example, guanidine nitrate can be formed in-situ by combining and heating an appropriate mixture of dicyandiamide and ammonium nitrate. In such case, the beginning reaction materials may include dicyandiamide, silicon dioxide, ammonium nitrate and one or more materials selected from the group of Cu, $Cu_2O$, CuO and $Cu(OH)_2$, with the heat cycle producing the final composition containing guanidine nitrate, copper diamine dinitrate, $SiO_2$, and ammonium nitrate. In accordance with such processing, guanidine nitrate is the addition product of dicyandiamide and ammonium nitrate.

Processing of the compositions for inclusion into an airbag inflator device may, for example, be accomplished by spray drying the reaction ingredients in the form of a water slurry to form solid prills of the reactant materials. The solid prills can then be heated to a desired temperature. e.g., a temperature of approximately 160° C., whereby the reactants react to form the desired gas generant material containing between about 15 and about 55 wt % of copper diamine dinitrate, zinc diamine dinitrate or mixtures thereof.

The present invention is described in further detail in connection with the following examples which illustrate or simulate various aspects involved in the practice of the invention. It is to be understood that all changes that come within the spirit of the invention are desired to be protected and thus the invention is not to be construed as limited by these examples.

EXAMPLES

Comparative Examples 1–3 and Examples 1 and 2

TABLE 1, below, identifies the ingredients and the respective relative amounts (% by weight) for the particular gas generant compositions of Comparative Examples (CE) 1–3 and Examples (Ex) 1 and 2.

More specifically, the composition of CE 1, though it included a gas generating fuel (e.g., guanidine nitrate) and metal oxide additive (e.g., silicon dioxide) in accordance with the invention, only contained metal amine nitrate oxidizer (e.g., copper diamine dinitrate) in a relative amount of 7.17 wt %, significantly below the amount specified for the subject gas generant compositions.

Similarly, the composition of CE 2, though it included a gas generating fuel (e.g., guanidine nitrate) in accordance with the invention, only contained metal amine nitrate oxidizer (e.g., copper diamine dinitrate) in a relative amount of 7.64 wt %, significantly below the amount specified for the subject gas generant compositions and did not contain any metal oxide burn rate enhancing and slag formation additive, i.e., silicon dioxide.

Further, the composition of CE 3, though it included a gas generating fuel (e.g. guanidine nitrate) and metal amine nitrate oxidizer (e.g., copper diamine dinitrate) in accordance with the invention, did not contain any of the metal oxide additive (e.g., silicon dioxide) described herein.

In contrast, the gas generant compositions of Ex 1 and Ex 2 each contained a gas generating fuel (e.g., guanidine nitrate), a metal amine nitrate oxidizer (e.g., copper diamine dinitrate) and metal oxide additive (e.g., silicon dioxide) in accordance with the invention, with the composition of Ex 1 additionally including a quantity (e.g., 9.91 wt %) of ammonium nitrate.

TABLE 1

| | Trial | | | | |
|---|---|---|---|---|---|
| | CE 1 | CE 2 | CE 3 | Ex 1 | Ex 2 |
| Ingredient (wt %) | | | | | |
| guanidine nitrate | 46.91 | 49.66 | 47.71 | 47.58 | 41.38 |
| ammonium nitrate | 40.62 | 42.71 | 14.02 | 9.91 | 0.00 |
| copper diamine dinitrate | 7.17 | 7.64 | 38.07 | 37.41 | 53.51 |
| silicon dioxide | 5.00 | 0.00 | 0.00 | 5.10 | 5.11 |

TABLE 1-continued

| | Trial | | | | |
|---|---|---|---|---|---|
| | CE 1 | CE 2 | CE 3 | Ex 1 | Ex 2 |
| Results | | | | | |
| burning rate at 1000 psi (in/sec) | 0.300 | 0.295 | 0.281 | 0.464 | 0.521 |
| burning rate pressure exponent | 0.75 | 0.82 | 0.92 | 0.55 | 0.56 |

Discussion of Results

TABLE 1, above, also identifies the burning rate and the burning rate pressure exponent for each of these gas generant compositions. As shown the gas generant compositions in accordance with the invention (Examples 1 and 2) exhibited significantly higher or greater burning rates than similar compositions which did not include one or more of the specified components in a specified relative amount.

Similarly, the gas generant compositions in accordance with the invention (Examples 1 and 2) exhibited significantly reduced burning rate pressure exponents as compared with the similar compositions of CE 1, CE 2 and CE 3 which did not include one or more of the specified components in a specified relative amount.

Thus it will be appreciated that the invention provides gas generant compositions which provide or result in a very high gas output (e.g., generate in excess of about 3 moles of gas, preferably at least about 3.3 moles of gas per 100 grams of composition), a relatively high burning rate (e.g., desirably in excess of 0.35 inches per second at 1000 psi, preferably in excess of 0.45 inches per second at 1000 psi), and a low burning rate pressure exponent (e.g., a burning rate pressure exponent of less than 0.7, preferably less than about 0.6).

As will be appreciated, the gas generant compositions in accordance with the invention can provide relatively higher gas yields per unit volume as compared to typical or usual azide-based gas generants and which subject gas generant compositions can desirably burn more quickly and with reduced dependence on pressure. Further, the invention provides processing techniques which may desirably serve to avoid or minimize at least certain handling and processing complications and difficulties relating to certain of the component ingredients of the subject gas generant compositions.

It is to be understood that discussions of theory, such as the discussion regarding the theorized in-situ formation of CuO, for example, is included to assist in the understanding of the subject invention and is in no way limiting to the invention in its broader application.

The invention illustratively disclosed herein suitably may be practiced in the absence of any element, part, step, component or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. In a method of forming a burn rate-enhanced high gas yield non-azide gas generant which includes a gas generating fuel and between about 15 and about 55 wt % of a metal amine nitrate oxidizer wherein the metal of the metal amine nitrate is selected from the group of copper and zinc, the steps of:

adding ammonium nitrate and a material containing the metal of the metal amine nitrate with a first gas generant precursor material to form a second gas generant precursor material and heating the second gas generant precursor material to form a gas generant material containing between about 15 and about 55 wt % of:

copper diamine dinitrate, where the metal is copper and zinc diamine dinitrate, where the metal is zinc.

2. The method of claim 1 additionally comprising the step of spray drying the second gas generant precursor material prior to said heating step.

3. The method of claim 1 wherein the metal amine nitrate oxidizer is copper diamine dinitrate.

4. The method of claim 1 wherein the metal amine nitrate oxidizer is zinc diamine dinitrate.

5. The method of claim 1 wherein said heating step comprises heating the second gas generant precursor material to a temperature of at least about 160° C.

6. The method of claim 1 wherein the metal of the metal amine nitrate is copper and the material added with the ammonium nitrate is selected from the group consisting of Cu metal, $Cu_2O$, CuO and $Cu(OH)_2$.

7. The method of claim 6 wherein $Cu_2O$ is the material added with the ammonium nitrate.

8. The method of claim 1 wherein the first gas generant precursor material comprises a gas generating fuel comprising guanidine nitrate.

9. The method of claim 8 wherein the first gas generant precursor material comprises dicyandiamide with the guanidine nitrate gas generating fuel additionally being formed upon said heating step.

10. The method of claim 1 wherein the first gas generant precursor material comprises a non-azide gas generating fuel.

11. The method of claim 10 wherein the first gas generant precursor material comprises a nitrogen-containing organic fuel.

12. The method of claim 11 wherein the nitrogen-containing organic fuel is selected from the group consisting of aminoguanidine nitrate, triaminoguanidine nitrate, nitroguanidine, dicyandiamide, triazalone, nitrotriazalone, tetrazoles and mixtures thereof.

13. The method of claim 10 wherein the first gas generant precursor material comprises dicyandiamide.

14. The method of claim 10 wherein the first gas generant precursor material comprises a tetrazole complex of at least one transition metal.

15. The method of claim 10 wherein the first gas generant precursor material comprises a tetrazole complex of at least one transition metal selected from the group consisting of copper, cobalt, and zinc.

16. The method of claim 10 wherein the first gas generant precursor material comprises a metallic fuel material.

17. The method of claim 16 wherein the metallic fuel material is selected from the group consisting of silicon, aluminum, boron, magnesium, alloys of aluminum and magnesium and combinations thereof.

18. A method of forming a burn rate-enhanced high gas yield non-azide gas generant which includes a non-azide gas generating fuel and a metal amine nitrate oxidizer wherein the metal of the metal amine nitrate oxidizer is selected from the group of copper and zinc, the method comprising:

adding ammonium nitrate and a material containing the metal of the metal amine nitrate oxidizer with a first gas generant precursor material containing a non-azide gas generating fuel to form a second gas generant precursor material and heating the second gas generant precursor material to form a gas generant material containing copper diamine dinitrate, where the metal of the metal amine nitrate oxidizer is copper and zinc diamine dinitrate, where the metal of the metal amine nitrate oxidizer is zinc.

19. The method of claim 18 wherein prior to said heating, said method additionally comprises spray drying a water slurry containing the second gas generant precursor material.

20. The method of claim 18 wherein the burn rate-enhanced high gas yield non-azide gas generant contains no more than about 55 wt % of the metal amine nitrate oxidizer.

* * * * *

UNITED STATES PATENT AND TRADEMARK OFFICE

CERTIFICATE OF CORRECTION

PATENT NO. : 6,083,331

DATED : July 4, 2000

INVENTOR(S) : Robert D. Taylor, et al.

It is certified that error appears in the above-identified patent and that said Letters Patent is hereby corrected as shown below:

In column 3, line 3 delete "amine" and in lieu thereof insert --ammine.--

In column 3, line 24 delete "diamine" and in lieu thereof insert --diammine.--

In column 3, line 34 delete "amine" and in lieu thereof insert --ammine.--

In column 3, line 35 delete "amine" and in lieu thereof insert --ammine.--

In column 3, line 38 delete "amine" and in lieu thereof insert --ammine.--

In column 3, line 43 delete "diamine" and in lieu thereof insert --diammine.--

In column 3, line 44 delete "diamine" and in lieu thereof insert --diammine.--

In column 3, line 56 delete "amine" and in lieu thereof insert --ammine.--

In column 4, line 46 delete "amine" and in lieu thereof insert --ammine.--

In column 4, line 47 delete "amine" and in lieu thereof insert --ammine.--

In column 4, line 49 delete "diamine" and in lieu thereof insert --diammine.-- (2 occurrences)

In column 4, line 60 delete "amine" and in lieu thereof insert --ammine.--

In column 4, line 64 delete "amine" and in lieu thereof insert --ammine.--

In column 4, line 67 delete "amine" and in lieu thereof insert --ammine.--

In column 5, line 3 delete "amine" and in lieu thereof insert --ammine.--

UNITED STATES PATENT AND TRADEMARK OFFICE

CERTIFICATE OF CORRECTION

PATENT NO. : 6,083,331

DATED : July 4, 2000

INVENTOR(S) : Robert D. Taylor, et al.

It is certified that error appears in the above-identified patent and that said Letters Patent is hereby corrected as shown below:

In column 5, line 8, delete "amine" and in lieu thereof insert --ammine.--

In column 5, line 10 delete "amine" and in lieu thereof insert --ammine.--

In column 5, line 13 delete "amine" and in lieu thereof insert --ammine.--

In column 5, line 15 delete "amine" and in lieu thereof insert --ammine.--

In column 5, line 36 delete "amine" and in lieu thereof insert --ammine.--

In column 5, line 45 delete "diamine" and in lieu thereof insert --diammine.--

In column 5, line 56 delete "amine" and in lieu thereof insert --ammine.--

In column 5, line 56 delete "diamine" and in lieu thereof insert --diammine.--

In column 5, line 57 delete "diamine" and in lieu thereof insert --diammine.--

In column 5, line 61 delete "diamine" and in lieu thereof insert --diammine.--

In column 5, line 65 delete "diamine" and in lieu thereof insert --diammine.--

In column 5, line 66 delete "amine" and in lieu thereof insert --ammine.--

UNITED STATES PATENT AND TRADEMARK OFFICE

CERTIFICATE OF CORRECTION

PATENT NO. : 6,083,331

DATED : July 4, 2000

INVENTOR(S) : Robert D. Taylor, et al.

It is certified that error appears in the above-identified patent and that said Letters Patent is hereby corrected as shown below:

In column 5, line 66 delete "diamine" and in lieu thereof insert --diammine.--

In column 6, line 2 delete "diamine" and in lieu thereof insert --diammine.--

In column 6, line 4 delete "diamine" and in lieu thereof insert --diammine.--

In column 6, line 7 delete "diamine" and in lieu thereof insert --diammine.--

In column 6, line 15 delete "amine" and in lieu thereof insert --ammine.--

In column 6, line 30 delete "diamine" and lieu thereof insert --diammine.--

In column 6, line 40 delete "diamine" and in lieu thereof insert --diammine.--

In column 6, line 45 delete "diamine" and in lieu thereof insert --diammine.--

In column 6, line 64 delete "diamine" and in lieu thereof insert --diammine.--

In column 7, line 9 delete "diamine" and in lieu thereof insert --diammine.-- (2 occurrences)

In column 7, line 31 delete "amine" and in lieu thereof insert --ammine.--

In column 7, line 32 delete "diamine" and in lieu thereof insert --diammine.--

In column 7, line 37 delete "amine" and in lieu thereof insert --ammine.--

In column 7, line 38 delete "diamine" and in lieu thereof insert --diammine.--

UNITED STATES PATENT AND TRADEMARK OFFICE

CERTIFICATE OF CORRECTION

PATENT NO. : 6,083,331

DATED : July 4, 2000

INVENTOR(S) : Robert D. Taylor, et al.

It is certified that error appears in the above-identified patent and that said Letters Patent is hereby corrected as shown below:

In column 7, line 44 delete "amine" and in lieu thereof insert --ammine.--

In column 7, line 45 delete "diamine" and in lieu thereof insert --diammine.--

In column 7, line 51 delete "amine" and in lieu thereof insert --ammine.--

In column 7, line 51 delete "diamine" and in lieu thereof insert --diammine.--

In column 7, line 65 delete "diamine" and in lieu thereof insert --diammine.--

In column 9. line 2, delete "amine" and in lieu thereof insert --ammine.-- (2 occurrences)

In column 9, line 6 delete "amine" and in lieu thereof insert --ammine.--

In column 9, line 17 delete "amine" and in lieu thereof insert --ammine.--

In column 9, line 18 delete "diamine" and in lieu thereof insert --diammine.--

In column 9, line 19 delete "amine" and in lieu thereof insert --ammine.--

In column 9, line 20 delete "diamine" and in lieu thereof insert --diammine.--

In column 9, line 25 delete "amine" and in lieu thereof insert --ammine.--

In column 10, line 22 delete "amine" and in lieu thereof insert --ammine.--

In column 10, line 23 delete "amine" and in lieu thereof insert --ammine.--

UNITED STATES PATENT AND TRADEMARK OFFICE

CERTIFICATE OF CORRECTION

PATENT NO. : 6,083,331

DATED : July 4, 2000

INVENTOR(S) : Robert D. Taylor, et al.

It is certified that error appears in the above-identified patent and that said Letters Patent is hereby corrected as shown below:

In column 10, line 26 delete "amine" and in lieu thereof insert --ammine.--

In column 10, line 32 delete "diamine" and in lieu thereof insert --diammine.--

In column 10, line 33 delete "amine" and in lieu thereof insert --ammine.--

In column 10, line 34 delete "diamine" and in lieu thereof insert --diammine.--

In column 10, line 35 delete "amine" and in lieu thereof insert --ammine.--

In column 10, line 42 delete "amine" and in lieu thereof insert --ammine.--

Signed and Sealed this

Fifth Day of December, 2000

*Attest:*

Q. TODD DICKINSON

*Attesting Officer*

*Director of Patents and Trademarks*